US009217286B2

(12) United States Patent
Sitka

(10) Patent No.: US 9,217,286 B2
(45) Date of Patent: Dec. 22, 2015

(54) ANTI-REVERSE MECHANISM FOR MUD MOTOR

(71) Applicant: Halliburton Energy Services, Inc., Houston, TX (US)

(72) Inventor: Mark A. Sitka, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 190 days.

(21) Appl. No.: 14/006,752

(22) PCT Filed: Dec. 21, 2012

(86) PCT No.: PCT/US2012/071282
§ 371 (c)(1),
(2) Date: Sep. 23, 2013

(87) PCT Pub. No.: WO2014/098899
PCT Pub. Date: Jun. 26, 2014

(65) Prior Publication Data

US 2015/0218885 A1 Aug. 6, 2015

(51) Int. Cl.
*F16D 63/00* (2006.01)
*E21B 4/02* (2006.01)
*E21B 4/00* (2006.01)

(52) U.S. Cl.
CPC .. *E21B 4/02* (2013.01); *E21B 4/003* (2013.01)

(58) Field of Classification Search
USPC ..... 188/82.84, 82.8; 175/92
See application file for complete search history.

(56) References Cited

U.S. PATENT DOCUMENTS

| | | | | |
|---|---|---|---|---|
| 3,675,727 | A * | 7/1972 | Clark | 175/26 |
| 4,187,918 | A | 2/1980 | Clark | |
| 4,593,774 | A | 6/1986 | Lingafelter | |
| 4,636,151 | A * | 1/1987 | Eppink | 418/48 |
| 5,092,687 | A * | 3/1992 | Hall | 384/303 |
| 5,350,242 | A | 9/1994 | Wenzel | |
| 6,564,911 | B2 * | 5/2003 | Mills | 188/82.8 |
| 7,086,486 | B2 | 8/2006 | Ravensbergen et al. | |

(Continued)

FOREIGN PATENT DOCUMENTS

| | | | |
|---|---|---|---|
| WO | 2006119022 | A2 | 11/2006 |
| WO | 2012069858 | A2 | 5/2012 |

OTHER PUBLICATIONS

International Search Report and Written Opinion for PCT/US2012/071282 dated Aug. 16, 2013.

*Primary Examiner* — Giovanna C Wright
*Assistant Examiner* — Ronald Runyan
(74) *Attorney, Agent, or Firm* — McDermott Will & Emery LLP; Scott Brown

(57) ABSTRACT

Disclosed are systems and methods for preventing backdriving of a mud motor through its output. One disclosed mud motor may include a housing having a longitudinal axis, a rotor disposed within the housing and configured to rotate generally about the longitudinal axis in a first direction with respect to the housing when a flow of fluid is provided to the power generator, an output shaft at least partially disposed within the housing and coupled to the rotor, and an anti-reverse bearing arranged radially between the output shaft and the housing and configured to support the output shaft within the housing and allow rotation of the output shaft in the first direction but resist rotation of the output shaft in a second direction about the longitudinal axis with respect to the housing, the second direction being opposite the first direction.

20 Claims, 2 Drawing Sheets

(56) References Cited

U.S. PATENT DOCUMENTS

| | | | | |
|---|---|---|---|---|
| 7,377,337 | B2 | 5/2008 | Swietlik et al. | |
| 7,735,581 | B2 | 6/2010 | Beylotte et al. | |
| 2006/0241743 | A1 * | 10/2006 | Bergin et al. | 623/2.11 |
| 2009/0057461 | A1 | 3/2009 | Hayashi | |

* cited by examiner

ANTI-REVERSE MECHANISM FOR MUD MOTOR

BACKGROUND

This disclosure describes systems and methods directed toward an anti-reversal bearing adapted for use as part of a mud motor to prevent back-driving of the mud motor through the output.

Downhole mud motors have been utilized to drill with a non-rotating drill string using the mud flow to power a mud motor that rotates the drill bit. With the advent of improved drill bits, it has become common to rotate the drill string with a surface drive in unison with the mud motor to achieve higher rotational speeds.

When drilling a well, the drill bit can become snagged or stuck on a subterranean formation. In order to free the drill bit, it may be necessary to apply a very large torque using the surface drive, which can apply more torque than what is typically available from the downhole mud motor. The torque applied by the surface motor is transferred to the mud motor housing and through the mud motor to the drill bit. With a conventional mud motor, the large torque from the surface can exceed the torque capability of the mud motor and may result in backdriving the mud motor, i.e. driving the rotor backwards within the housing, which may damage or destroy the mud motor.

In certain conventional drilling operations, a one-way clutch has been installed in the drill string between the output of the mud motor and the drill bit. Such clutches typically allow a significant amount of reverse motion before the clutch locks. Nevertheless, this reverse motion allows some back-drive of the rotor, which may be damaging to internal elements of the mud motor, and allows the drill string to acquire momentum that, when the clutch locks, will create a large impulse load on the clutch that may limit the operational life of the clutch.

SUMMARY OF THE DISCLOSURE

This disclosure describes systems and methods directed toward an anti-reversal bearing adapted for use as part of a mud motor to prevent back-driving of the mud motor through the output.

In certain embodiments, a power generator is disclosed that includes a housing having a longitudinal axis, a rotor disposed within the housing and configured to rotate generally about the longitudinal axis in a first direction with respect to the housing in response to a flow of fluid to the power generator, an output shaft at least partially disposed within the housing and coupled to the rotor, and an anti-reverse bearing arranged radially between the output shaft and the housing and configured to support the output shaft within the housing and allow rotation of the output shaft in the first direction but resist rotation of the output shaft in a second direction opposite the first direction about the longitudinal axis with respect to the housing.

In certain embodiments, a method of drilling is disclosed. The method includes the step of rotating a rotor of a downhole motor in a first direction at a first speed with a first torque. The rotor is operatively coupled to a drill bit arranged downhole from the downhole motor. The method also includes the step of rotating a drill string from a surface location in the first direction at a second speed with a second torque. The drill string is coupled to a housing of the downhole motor and the rotor being supported for rotation within the housing by at least one anti reverse bearing. The method also includes the step of resisting rotation of the rotor with the at least one anti reverse bearing in a second direction opposite the first direction when the second torque surpasses the first torque.

The features and advantages of the present disclosure will be readily apparent to those skilled in the art upon a reading of the description of the preferred embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This disclosure describes systems and methods directed toward an anti-reversal bearing adapted for use as part of a mud motor to prevent back-driving of the mud motor through the output.

The embodiments of the exemplary power generator described herein include an anti-reverse bearing that provides rotational support for the rotor (or a coupled output shaft) within the housing of the power generator but also serves to prevent backdriving of the rotor within the housing. The integration of anti-reverse capabilities into an existing support bearing may prove advantageous as compared to conventional drive systems that have a separate anti-reverse mechanisms provided in a separate assembly as coupled to the power generator. The improved design of the disclosed embodiments may provide an increase in the reliability of the string of downhole equipment, for example by elimination of certain points of potential failure. The improved design of the power generator may also provide a reduction of the cost of fabrication of the power generator or a reduction in the cost of repairs while in service.

Within this disclosure, the phrase "power generator" means any type of power generator that is powered by a flow of a fluid and suitable for deployment downhole in a drilling operation. Power generators, some of which are referred to as "downhole motors," "turbines," or "mud motors," may be driven by a flow of drilling fluid, commonly referred to as "mud," pumped from the surface to the drill bit, but may be driven by other fluids. Power generators are commonly used to rotate the drill bit but may be used to provide rotary motion to other systems, such as an electric generator. Power generators may be controlled through hard lines, such as electric cables or hydraulic lines, or may be controlled wirelessly, such as through acoustic signals transmitted to and/or received from the power generator through the mud within the borehole. While this disclosure provides examples of a power generator configured to rotate a drill bit, it should be noted that the same systems and methods may be applied to other downhole power generators.

Figure 1:
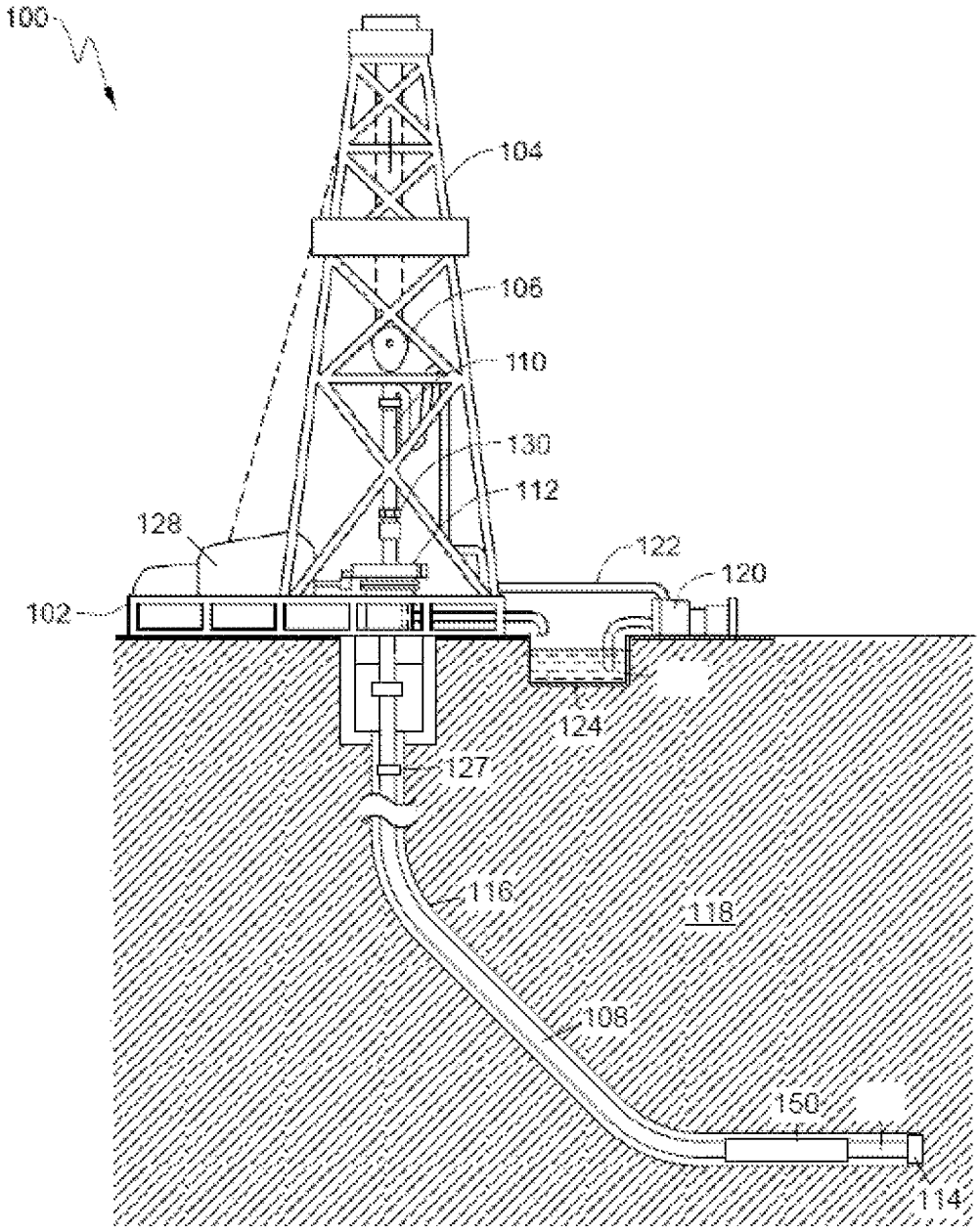
FIG. 1 illustrates a land-based oil and gas rig including a downhole power generator that may be employed to drive a drill bit, according to the one or more embodiments of this disclosure.

FIG. 1 illustrates a land-based oil and gas rig 100 including a downhole power generator 150 that may be employed to drive a drill bit 114, according to the one or more embodiments of this disclosure. It should be noted that, even though FIG. 1 depicts a land-based oil and gas rig 100, it will be appreciated by those skilled in the art that the exemplary downhole power generator 150, and its various embodiments disclosed herein, are equally well suited for use in or on other types of oil and gas rigs, such as offshore platforms or rigs, or rigs arranged in any other geographical location.

As illustrated in FIG. 1, a drilling platform 102 supports a derrick 104 having a traveling block 106 for raising and lowering a drill string 108. A kelly 110 supports the drill string 108 as it is lowered through a rotary table 112. The kelly 110 may be, for example, a four or six-sided pipe configured to transfer rotary motion from a turntable 130 to the drill string 108. A drive motor 128 may be coupled to the turntable 130 to drive the turntable 130 so as to be able to rotate the drill string 108. In certain embodiments, a top drive (not shown in FIG. 1) may be used to rotate the drill string 108 from the surface as an alternative to using a rotary table to rotate the drill string 108 from the surface. A drill bit 114 is driven either by a power generator 150 and/or via rotation of the drill string 108 by the drive motor 128 and may include one or more drill pipe couplings 127 arranged along the drill string 108. As the bit 114 rotates, it creates a borehole 116 that passes through various subterranean formations 118. A pump 120 circulates drilling fluid (e.g. mud) through a feed pipe 122 to the kelly 110, which conveys the drilling fluid downhole through an interior conduit in the drill string 108 and through one or more orifices in the drill bit 114. The drilling fluid is then circulated back to the surface via the annulus defined between the drill string 108 and the borehole 116 where it is eventually deposited in a retention pit 124. The drilling fluid transports cuttings and debris derived from the borehole 116 into the retention pit 124 and aids in maintaining the integrity of the borehole 116.

Figure 2:
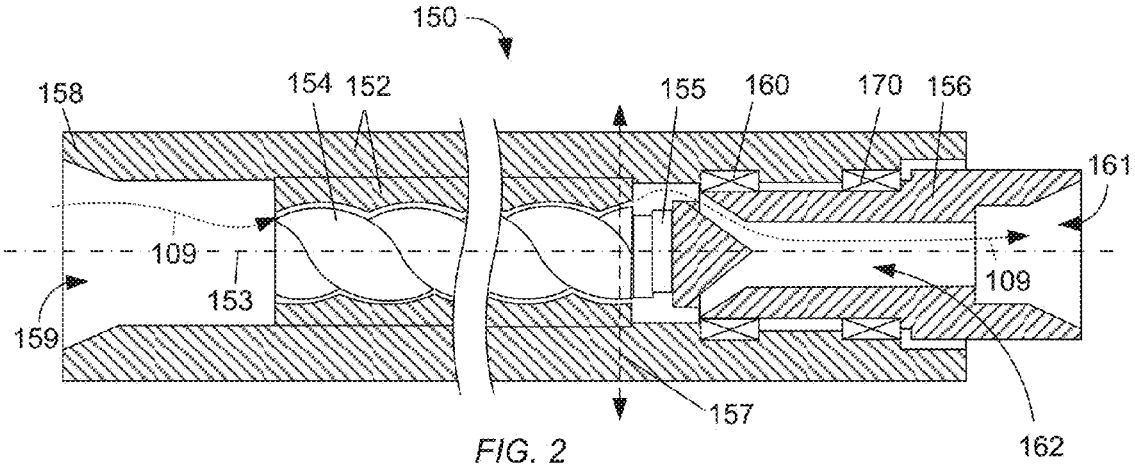
FIG. 2 is a cross-section of an example power generator with a anti-reverse bearing, according to the one or more embodiments of this disclosure.

FIG. 2 is a cross-section of an example power generator 150 that may include or otherwise employ an anti-reverse bearing 170, according to the one or more embodiments of this disclosure. The power generator 150 has a housing 152 that includes or otherwise encompasses a stator element and a rotor 154. The housing 152 has a longitudinal axis 153. In certain embodiments, a downhole end of the rotor 154 may be coupled or otherwise attached to an uphole end of an output shaft 156 that is typically supported by at least one bearing 160. In certain embodiments, the bearing 160 may provide radial and axial, i.e. thrust, support to the shaft 156. In other embodiments, however, the output shaft 156 may form an integral part of the rotor 154 such that the rotor 154 may extend longitudinally along the entire length of the housing 152, wherein bearings 160 and 170 support the rotor 154, without departing from the scope of the disclosure. The power generator 150 is powered by a flow of a pressurized fluid, e.g. drilling fluid or mud, provided from the surface. In certain embodiments, the drilling fluid is provided through opening 159 and follows the flow path 109 of FIG. 2 wherein the drilling fluid passes between the rotor 154 and stator 152 and then flows through the passage 162 of shaft 156 and out the opening 161. In exemplary operation, the power generator 150 may be capable of generating a maximum torque from the maximum flow rate and/or pressure of the pressurized fluid provided thereto.

In certain embodiments, a flex joint 155 may be coupled between the downhole end of the rotor 154 and the uphole end of the output shaft 156. The flex joint may be configured to transfer torque from the rotor 154 to the output shaft 156. In certain embodiments, the flex joint 155 may be configured to resist angular motion of the downhole end of the rotor 154 about the longitudinal axis 153 relative to the uphole end of the output shaft 156. In certain embodiments, the downhole end of the rotor 154 moves laterally, i.e. in a plane perpendicular to the longitudinal axis 153, as generally indicated by the arrow 157. In certain embodiments, the flex joint 155 may resist angular motion of the downhole end of the rotor 154 about the longitudinal axis 153 relative to the uphole end of the output shaft 156 while allowing lateral motion of the downhole end of the rotor 154 relative to the uphole end of the output shaft 156.

In certain embodiments, an anti-reverse bearing 170 may be disposed between the output shaft 156 and the housing 152. The anti-reverse bearing 170 may provide lateral support for the output shaft 156 as it rotates within the housing 152. In certain embodiments, the anti-reverse may also provide axial support, i.e. thrust support, for the shaft 156. The anti-reverse bearing 170 may allow rotation of the output shaft 156 in a first direction about the longitudinal axis 153, e.g., a clockwise rotation of the output shaft 156 with respect to the housing 152. Moreover, the anti-reverse bearing 170 may be configured to resist rotation of the output shaft 156 in a second direction about the longitudinal axis 153 with respect to the housing 152; the second direction being opposite the first direction, e.g., counterclockwise.

The housing 152 has an uphole end that may include a coupling 158 configured to connect the housing 152 to a drill pipe (not shown in FIG. 2) or other uphole element of a drill string. In certain embodiments, a flow of a fluid, e.g. a drilling fluid or mud, may be provided through an attached drill pipe into an opening 159 of the housing 152. The flow of fluid into the power generator 150 may be configured to drive the rotor 154 to rotate, e.g. rotate in the first direction. The construction and operation of various types of downhole power generators is well known to those of skill in the art. Accordingly, the internal flow channels and components used to manage the flow of the fluid and the generation of torque or power by the power generator 150 are omitted for clarity. Likewise, method of controlling power generators are also well known to those of skill in the art and therefore control elements, such as hydraulic lines, electrical signal lines, and wireless transceivers, are also omitted for clarity.

The output shaft 156 may have a downhole end that includes a coupling configured to operatively connect the rotor 154 to a drill bit (not shown in FIG. 2), for example, or another type of downhole assembly, e.g., a weight-on-bit (WOB) sub, a torque-on-bit (TOB) sub, a sensor package containing measurement-while-drilling (MWD) instruments, or a steering sub. In certain embodiments, the fluid that enters the opening 159 may be conveyed through the rotor 154 and output shaft 156 and leaves the power generator 150 through an opening 161 defined in the downhole end of the output shaft 156.

Figure 3A:
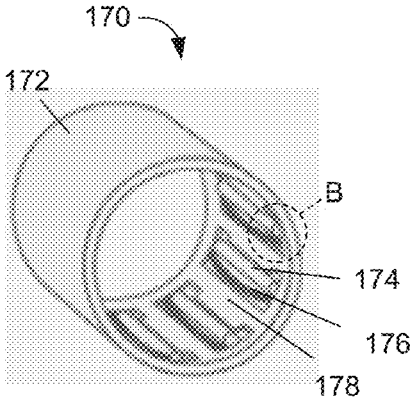
FIGS. 3A-3B depicts an example anti-reverse bearing, according to the one or more embodiments of this disclosure.
Figure 3B:
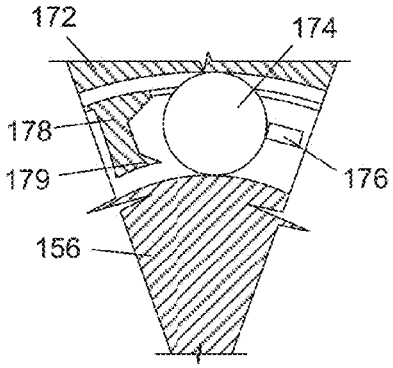

FIGS. 3A-3B depict an example anti-reverse bearing 170, according to one or more embodiments of this disclosure. It should be noted that the anti-reverse bearing 170 shown in FIGS. 3A and 3B is described herein for illustrative purposes only and therefore should not be considered limiting to the scope of the disclosure. Indeed, the general description of the anti-reverse bearing 170 and its various components is used merely to disclose the general function of an exemplary anti-reverse bearing that may be suitably used in the systems and methods disclosed herein. Those skilled in the art will readily appreciated that other types and designs of anti-reverse bearings that provide both support for a rotating shaft and an anti-reverse function may be used in place of the presently described anti-reverse bearing 170, without departing from the scope of this disclosure.

The exemplary anti-reverse bearing 170 has, in the illustrated embodiment, an outer race 172, a plurality of rollers 174, a bearing cage 178, and a plurality of spring elements 176. In certain embodiments, the outer race 172 may be fixedly mounted within the housing 152 and can be considered to be a functional part of the housing 152. In certain embodiments, the outer race 172 may be formed as an integral part of the housing 152. The rollers 174 of the anti-reverse bearing 170 may roll directly on or otherwise engage the output shaft 156. In other embodiments, however, the anti-reverse bearing 170 may include an inner race (not shown in FIG. 3A) fixedly mounted on the output shaft 156 such that the rollers 174 roll therein, instead of directly engaging the output shaft 156.

FIG. 3B is an enlarged side view of the portion of the anti-reverse bearing 170 indicated by the dashed line circle labeled "B" in FIG. 3A. One of the plurality of rollers 174 is shown in contact with both the outer race 172 and the output shaft 156. The bearing cage 178 has a portion that protrudes downward between adjacent rollers 174. The surface of the protruding portion that faces toward the roller 174 has an angled tip 179 that will wedge, in this embodiment, between the roller 174 and the output shaft 156 if the roller 174 comes into contact with the tip 179. The spring element 176 is arranged to urge the roller 174 toward the tip 179 but, in certain embodiments, does not apply sufficient force to slide the roller 174 with respect to the output shaft 156.

When the output shaft 156 rotates clockwise in the view of FIG. 3B, with respect to the outer race 172, the roller 174 will tend to move toward the spring element 176 and, as the output shaft 156 continues to rotate, drag the bearing cage 178 along with the roller 174 while maintaining a gap between the tip 179 and the roller 174. However, when the output shaft 156 rotates in the opposite direction, i.e., counterclockwise in the view of FIG. 3B, the roller 174 may be forced against the tip 179. When the roller 174 contacts the tip 179, the tip 179 will become wedged between the roller 174 and the output shaft 156, thereby preventing further rotation of the output shaft 156 with respect to the outer race 172 and the housing 152. In certain embodiments, the anti-reverse bearing 170 may include only the plurality of rollers 174, or similar, and the bearing cage 178, or similar, configured to stop rotation of the rollers 174 when the output shaft 156 rotates in a reverse direction.

According to embodiments disclosed herein, the anti-reverse bearing 170 may be configured to limit the amount of reverse motion of the output shaft 156 with respect to the housing 152 in order to protect the internal components of the power generator 150. For example, the flex joint 155 may have a torque capability that is only slightly larger than the maximum rated capability of the power generator 150 and, if backdriven with a torque that exceeds the maximum capability, the flex joint 155 could be damaged or destroyed before the rotor 154 is permanently damaged. In certain embodiments of the anti-reverse bearing 170, the output shaft 156 may rotate counterclockwise, with respect to the housing 152, by up to 5° of relative angular rotation before the anti-reverse bearing 170 locks. In certain embodiments, the anti-reverse bearing 170 may lock within 2° of relative angular rotation. In certain embodiments, the anti reverse bearing 170 may lock within 1° of relative angular rotation.

Figure 4A:
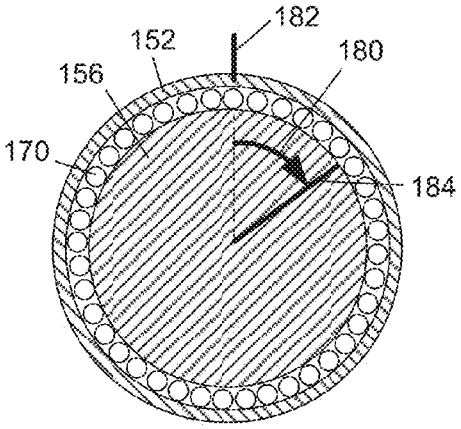
FIGS. 4A-4B are cross-sections of the power generator of FIG. 2 showing the relative rotation of the output shaft and housing, according to the one or more embodiments of this disclosure.
Figure 4B:
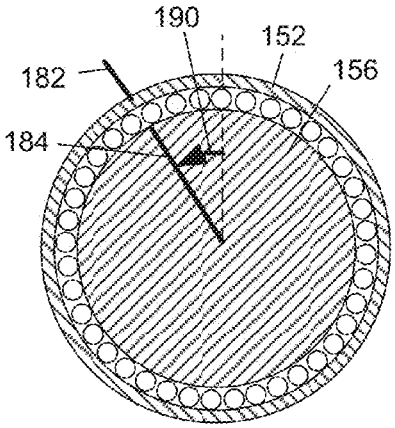

FIGS. 4A-4B are cross-sections of the power generator 150 of FIG. 2 showing the relative rotation of the output shaft 156 and housing 152, according to the one or more embodiments of this disclosure. FIGS. 4A-4B are both depicted as seen when looking downhole, i.e., from the surface. The anti-reverse bearing 170 is visible in FIGS. 4A-4B as a plurality of rollers. Referring to FIG. 4A, the housing 152 is held fixed, as indicated by the vertical orientation of the reference line 182 related to the angular position of the housing 152. The output shaft 156 has been rotated in a direction indicated by the arrow 180, clockwise in FIG. 4A, as indicated by the rotated orientation of the reference line 184 related to the angular position of the output shaft 156. During normal operation, the output shaft 156 may continue to freely rotate in this direction with respect to the housing 152 as supported by the bearing 170.

Referring to FIG. 4B, the output shaft 156 has been rotated in a counterclockwise direction as indicated by the arrow 190, as indicated by the rotated orientation of the reference line 184. As the output shaft 156 begins to rotate counterclockwise with respect to the housing 152, however, the anti-reverse bearing 170 may lock and otherwise prevent further counterclockwise rotation of the output shaft 156 with respect to the housing 152. With the anti-reverse bearing 170 locked, the housing 152 may synchronously rotate with the output shaft 156, as indicated by the general alignment of reference lines 184 and 182.

To facilitate a better understanding of the present disclosure, the following examples of preferred or representative embodiments are given. In no way should the following examples be read to limit, or to define, the scope of the disclosure.

EXAMPLES

For an example using a drilling rig 100 as shown in FIG. 1 with the capability to rotate the drill string 108 and a downhole power generator 150, the torque that can be applied by the drive motor 128 to the drill string 108 may be larger than the maximum torque capability of the power generator 150.

In order to provide a higher rotational speed of the drill bit 114, the operators may operate the power generator 150 while, at the same time, rotating the drill string 108. If, for example, the power generator 150 rotates at a first speed of 200 rotations per minute (rpm) in a forward rotational direction and the drill string 108 is rotated in the same forward rotational direction at a second speed of 150 rpm, then the drill bit 114 will rotate at a third speed of 350 rpm (i.e., the sum of the first and second speeds). When using drill bits that are capable of operating at this higher rotational speed, this may increase the rate-of-penetration (ROP) for this drilling operation. As long as the torque applied by the drill string 108 to the power generator 150 is less than or equal to the maximum torque capability of the power generator 150, the drill bit 114 will rotate in the forward rotational direction at the third speed. In certain embodiments, the torque applied to the drill string 108 is generally equal to the torque generated by the power generator 150 when the torque applied by the drill string 108 to the power generator 150 is less than or equal to the maximum torque capability of the power generator 150.

In certain embodiments, the drill bit 114 will rotate in the first direction at the speed of the drill string 108 when the torque applied by the drill string 108 to the power generator 150 is greater than the maximum torque capability of the power generator 150. When the torque applied by the drill string 108 is greater than the maximum torque capability of the power generator 150, the torque applied by the drill string 108 is transferred through the housing 152 and the anti-reverse bearing 170 and to the output shaft 156 which conveys the torque force to the drill bit 114. As such, the drill string 108 may, in at least one embodiment, be configured to apply a torque force that is greater than the maximum torque capability of the power generator 150 to the drill bit 114.

A second example situation is when the drill bit 114 has become stuck in the borehole 116 while drilling. In such cases, the power generator 150 may not be able to provide sufficient torque force to free the drill bit 114 and therefore ceases rotation. In this situation, the operator may choose to provide a torque through the drill string 108 that exceeds the maximum torque capability of the power generator 150. With a conventional mud motor, applying an over-torque in this manner would likely damage or destroy the mud motor. With the disclosed power generator 150, however, the anti-reverse bearing 170 may be configured to lock up as the housing 152 starts to rotate in the forward rotational direction with respect to the output shaft 156. Once the anti-reverse bearing 170 is locked, the torque applied to the housing 152 through rotation of the drill string 108 may then be transferred directly from the housing 152, through the anti-reverse bearing 170, and to the output shaft 156. During this mode of operation, no torque is created between the rotor 154 and the housing 152 and as such, the torque applied by the drill string 108 can be much larger, for example 2 to 5 times the maximum torque capability of the power generator 150. As a result, torque may be applied through the drill string 108 to free the stuck drill bit 114 without risking damage to the power generator 150 by backdriving the rotor 154.

A third example situation is when the power generator 150 fails and is no longer operative. As the anti-rotation bearing 170 prevents counterclockwise rotation of the rotor 154 relative to the housing 152, a clockwise rotation of the housing 152 will cause the rotor 154 to synchronously rotate with the housing 152 in the clockwise direction even when the power generator 150 is not able to generate any torque. Thus, drilling may continue with surface rotation only, allowing a delay in tripping the power generator 150.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A power generator, comprising:
a housing having a longitudinal axis;
a rotor disposed within the housing to rotate about the longitudinal axis in a first direction with respect to the housing in response to a flow of fluid to the power generator;
an output shaft at least partially disposed within the housing and operatively coupled to the rotor; and
an anti-reverse bearing arranged radially between the output shaft and the housing to support the output shaft within the housing and allow rotation of the output shaft in the first direction but resist rotation of the output shaft in a second direction opposite the first direction about the longitudinal axis with respect to the housing, wherein the anti-reverse bearing includes:
an outer race fixedly attached to the housing;
a bearing cage disposed within the outer race and engageable with the output shaft to resist rotation in the second direction; and
a plurality of rollers that interpose the outer race and the output shaft and force the bearing cage into engagement with the output shaft when the output shaft is moved in the second direction.

2. The power generator of claim 1, further comprising a flex joint operatively coupling the rotor to the output shaft.

3. The power generator of claim 1, wherein the output shaft is an integral part of the rotor.

4. The power generator of claim 1, wherein:
the housing is coupled at an uphole end to the drill pipe; and
the output shaft is coupled at a downhole end to a downhole assembly.

5. The power generator of claim 4, wherein the power generator comprises a maximum torque capability, and rotation of the drill pipe in the first direction at a first speed at a torque greater than the maximum torque capability engages the anti-reverse bearing and thereby rotates the downhole assembly at the first speed.

6. The power generator of claim 5, wherein the torque from the drill pipe is transferred to the housing, through the anti-reverse bearing, and to the output shaft and downhole assembly such that the downhole assembly rotates at the first speed.

7. The power generator of claim 5, wherein rotation of the drill pipe in the first direction at the first speed with a torque less than or equal to the maximum torque capability, while the rotor rotates with respect to the housing in the first direction at a second speed, rotates the downhole assembly at a third speed that is the sum of the first and second speeds.

8. The power generator of claim 1, wherein the anti-reverse bearing allows less than 5° of angular rotation of the output shaft in the second direction about the longitudinal axis with respect to the housing.

9. The power generator of claim 1, wherein the anti-reverse bearing further comprises a plurality of spring elements.

10. The power generator of claim 1, wherein the bearing cage further comprises an angled tip.

11. A method of drilling, comprising:

rotating a rotor of a downhole motor in a first direction at a first speed with a first torque, the rotor being operatively coupled to a drill bit arranged downhole from the downhole motor;

rotating a drill string from a surface location in the first direction at a second speed with a second torque, the drill string being coupled to a housing of the downhole motor and the rotor being supported for rotation within the housing by at least one anti-reverse bearing, wherein the anti-reverse bearing includes:

an outer race fixedly attached to the housing;

a bearing cage disposed within the outer race and engageable with the output shaft; and a plurality of rollers that interpose the outer race and the output shaft;

engaging the bearing cage with the plurality of rollers when the second torque surpasses the first torque and thereby forcing the bearing cage into engagement with the output shaft; and resisting rotation of the rotor with the at least one anti-reverse bearing in a second direction opposite the first direction.

12. The method of claim 11, further comprising torquing the drill bit in the first direction with the second torque when the second torque surpasses the first torque.

13. The method of claim 12, further comprising transferring the second torque to the housing, through the anti-reverse bearing, and to the output shaft and the drill bit.

14. The method of claim 11, further comprising rotating the drill bit in the first direction at a third speed that is the sum of the first and second speeds when the first torque is greater than or equal to the second torque.

15. The method of claim 14, wherein the first speed is relative to the housing and the second and third speeds are relative to a borehole wall.

16. The method of claim 11, wherein the rotor includes an output shaft operatively coupled thereto and the output shaft is operatively coupled to the drill bit, the method further comprising supporting the output shaft for rotation with the at least one anti-reverse bearing.

17. The method of claim 11, further comprising engaging the anti-reverse bearing on the rotor upon surpassing a maximum torque capability of the downhole motor and thereby rotating the drill bit at the second speed.

18. The method of claim 17, further comprising:

resisting rotation of the rotor with the at least one anti-reverse bearing in the second direction when the second torque surpasses the maximum torque capability of the downhole motor; and transferring the second torque to the housing, through the anti-reverse bearing, and to the output shaft and drill bit.

19. The method of claim 11, wherein engaging the bearing cage with the plurality of rollers comprises urging the plurality of rollers into engagement with the bearing cage with a plurality of spring elements.

20. The method of claim 11, further comprising wedging an angled tip defined on the bearing cage between the plurality of rollers and the output shaft.

* * * * *